US009027778B1

(12) United States Patent
Slawinski, Jr.

(10) Patent No.: US 9,027,778 B1
(45) Date of Patent: May 12, 2015

(54) REFUSE CONTAINER

(71) Applicant: Christopher Slawinski, Jr., Loganville, GA (US)

(72) Inventor: Christopher Slawinski, Jr., Loganville, GA (US)

( * ) Notice: Subject to any disclaimer, the term of this patent is extended or adjusted under 35 U.S.C. 154(b) by 0 days.

(21) Appl. No.: 14/204,745

(22) Filed: Mar. 11, 2014

Related U.S. Application Data

(60) Provisional application No. 61/851,697, filed on Mar. 12, 2013.

(51) Int. Cl.

| | |
|---|---|
| ***B65D 25/14*** | (2006.01) |
| ***B65F 1/06*** | (2006.01) |
| ***B65F 1/14*** | (2006.01) |
| *B65D 25/18* | (2006.01) |
| *B65D 25/16* | (2006.01) |

(52) U.S. Cl.
CPC ..... *B65F 1/06* (2013.01); *B65F 1/1421* (2013.01); *B65D 25/18* (2013.01); *B65D 25/16* (2013.01)

(58) Field of Classification Search
CPC .... B65F 1/06; B65F 2210/181; B65F 1/1421; B65F 1/163; B65F 1/068; B65D 43/262; B65D 43/26; B65D 25/18; B65D 25/16; B65D 25/14; Y10S 220/9081; Y10S 220/908
USPC ..... 220/495.01, 495.04, 495.06, 908, 220/908.1, 745, 913, 262, DIG. 27
See application file for complete search history.

(56) References Cited

U.S. PATENT DOCUMENTS

| | | | | |
|---|---|---|---|---|
| 5,143,242 | A | 9/1992 | Millasich | |
| 5,388,717 | A * | 2/1995 | LeVasseur | 220/495.06 |
| 6,199,714 | B1 * | 3/2001 | Thompson | 220/495.07 |
| 6,928,691 | B2 * | 8/2005 | Freeman | 15/339 |
| 7,273,155 | B1 | 9/2007 | Gray | |
| 7,285,928 | B1 * | 10/2007 | Jolly et al. | 318/280 |
| 7,712,623 | B2 | 5/2010 | Wentz | |
| 7,828,168 | B2 | 11/2010 | Gagnebin | |
| 8,573,265 | B1 | 11/2013 | Manninen | |
| 2004/0206760 | A1 | 10/2004 | Gagnebin | |
| 2004/0238542 | A1 | 12/2004 | Camp, Jr. | |
| 2006/0175336 | A1 | 8/2006 | Wang | |
| 2008/0083756 | A1 * | 4/2008 | Daniels | 220/495.04 |
| 2009/0095755 | A1 | 4/2009 | McCurry | |
| 2011/0100997 | A1 | 5/2011 | Gagnebin | |
| 2013/0306639 | A1 | 11/2013 | Kastner | |

* cited by examiner

*Primary Examiner* — Robert J Hicks
*Assistant Examiner* — Kareen Rush
(74) *Attorney, Agent, or Firm* — Meunier Carlin & Curfman, LLC

(57) ABSTRACT

A receptacle configurable for the removal of air or atmosphere from a container while preventing solids and liquids from entering a means for removing the air. The receptacle comprising a container, a first standoff and an air-permeable support.

19 Claims, 14 Drawing Sheets

REFUSE CONTAINER

CROSS-REFERENCE TO RELATED APPLICATIONS

This application claims the benefit of priority to U.S. Provisional Patent Application No. 61/851,697, filed Mar. 12, 2013, the disclosure of which is incorporated herein by reference in its entirety.

FIELD OF THE DISCLOSURE

This disclosure relates to receptacles of the type that receive bag liners and more particularly, to receptacles having a means for venting air trapped between the liner and its receptacle.

BACKGROUND

Wastebaskets, trashcans, and trash receptacles of various designs and configurations of the type that receive a "trash bag" liner and are able to remove air from between the liner and receptacle currently exhibit at least two deficiencies. The first problem occurs when the trash bag liner ruptures and the contents within the liner enter the means for venting air and restrict the flow of air. If the apparatus for venting is a mechanical engine, having foreign objects enter the mechanical engine can also damage the system.

The second problem occurs when attempting to clean the receptacle. With wastebasket systems that have a container permanently fixed to the apparatus for venting, it can be difficult and time consuming to properly clean the container. This problem can be exacerbated if the apparatus for venting is sensitive to the contact of cleaning product. In these cases, cleaning a container fixed to an apparatus for venting could potentially damage the apparatus.

SUMMARY

Disclosed herein is a receptacle configurable for the removal of air or atmosphere that includes a container, a first standoff, and an air-permeable support. The container may have a bottom wall that has a bottom interior surface and a bottom exterior surface. The container may also include a peripheral sidewall that extends upwardly from the bottom wall. The peripheral sidewall may circumscribe a receptive cavity and terminate in an open top end. The open top end may have a rim. The receptive cavity and/or the rim may be configured to receive a disposable liner.

The receptacle may also include a first standoff disposed on the interior surface of the bottom wall. The first standoff may include a top surface positioned at a second distance from the bottom interior surface and may also include a peripheral sidewall. The peripheral sidewall of the first standoff may extend upwardly from the bottom interior surface. The peripheral sidewall of the first standoff may circumscribe a first gas transfer chamber. Additionally, the peripheral sidewall of the first standoff may have at least one hole. The hole(s) may be positioned at a first distance from the bottom interior surface. The hole(s) may be configured in such a way as to provide fluid communication between the receptive cavity and the first gas transfer chamber.

The air-permeable support of the receptacle may comprise a top surface, a bottom surface, and a peripheral surface. The air-permeable support may be removably couplabled to the peripheral sidewall of the container. Additionally the air-permeable support may be positioned at a third distance from the bottom interior surface. The air-permeable support may also be positioned above the top surface of the first standoff.

The receptacle may additionally include a base. The base may have a top surface, a bottom surface and a peripheral sidewall. The top surface of the base maybe removable coupleable to the bottom exterior surface of the container.

The base may additionally include a second standoff. The second standoff may be disposed on the top surface of the base. The second standoff may include a top opening and a peripheral sidewall. The peripheral sidewall of the second standoff may extend downwardly from the top opening. The peripheral sidewall of the second standoff may circumscribe a second gas transfer chamber. Furthermore, the peripheral sidewall may terminate at the top surface of the base. When the base is coupled to the container the second gas transfer chamber may be fluidly connected to the first gas transfer chamber and the receptive cavity.

The second standoff may additionally include an air-permeable barrier. The air permeable member may include a top surface, a bottom surface, and a peripheral surface. The air permeable barrier may be coupled to the peripheral sidewall of the second standoff.

The receptacle may additionally include an apparatus coupled to the bottom surface of the base. The apparatus may be configured to transfer air or atmosphere from the receptive cavity of the container. The apparatus may transfer the air or atmosphere through the first and second gas transfer chambers and to an exhaust vent. The vent may be positioned in the peripheral sidewall of the base.

The details of one or more implementations of the disclosure are set forth in the accompanying drawings and the description below. Other features, objects, and advantages of the disclosure will be apparent from the description and drawings, and from the claims.

DESCRIPTION OF THE DRAWINGS

The following detailed description will be better understood when read in conjunction with the appended drawings, in which there is shown one or more of the multiple embodiments of the present disclosure. It should be understood, however, that the various embodiments of the present disclosure are not limited to the precise arrangements and instrumentalities shown.

In the drawings, like reference symbols indicate like elements.

DETAILED DESCRIPTION

Figure 1:
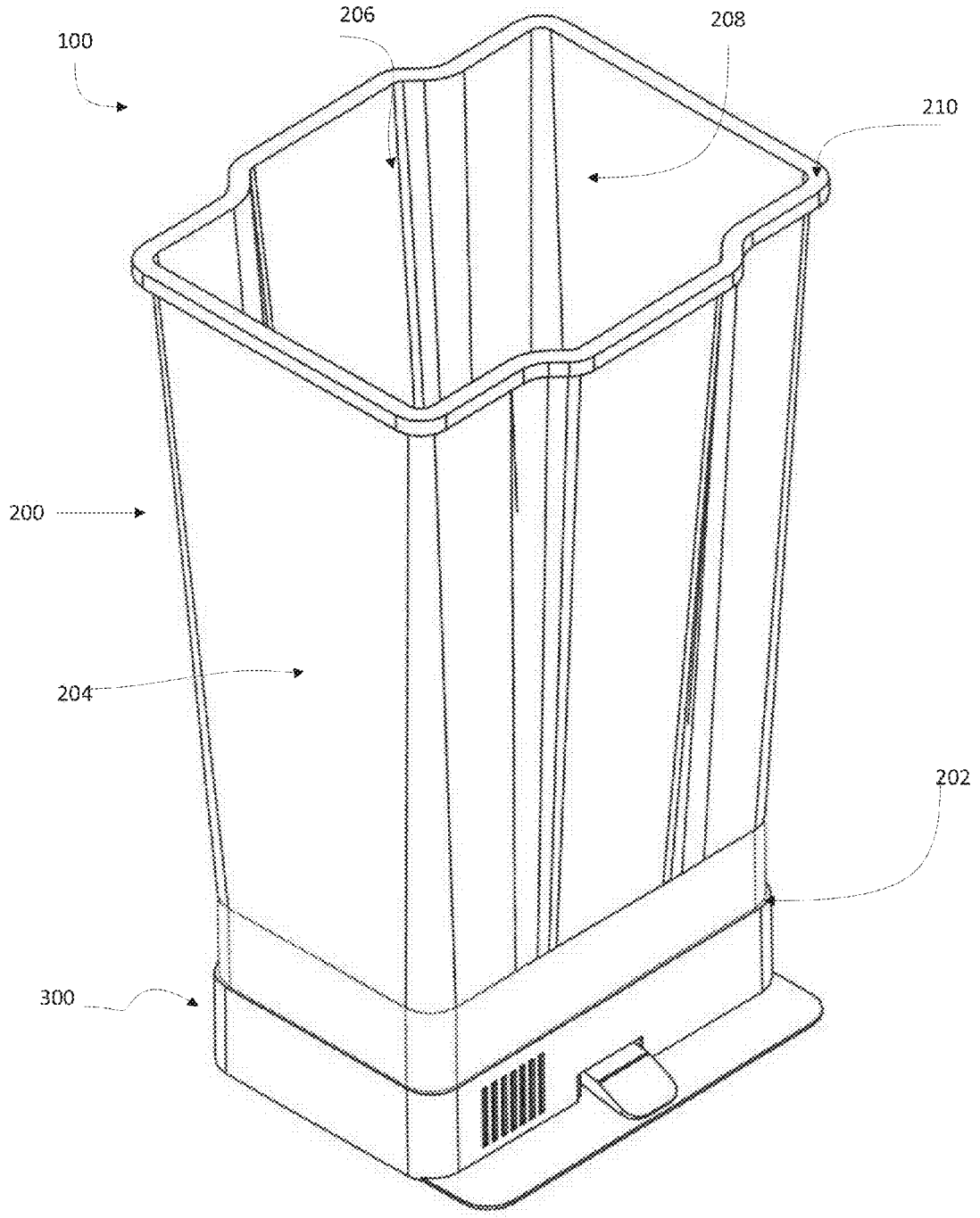
FIG. 1 is a perspective view of an example receptacle.
Figure 2:
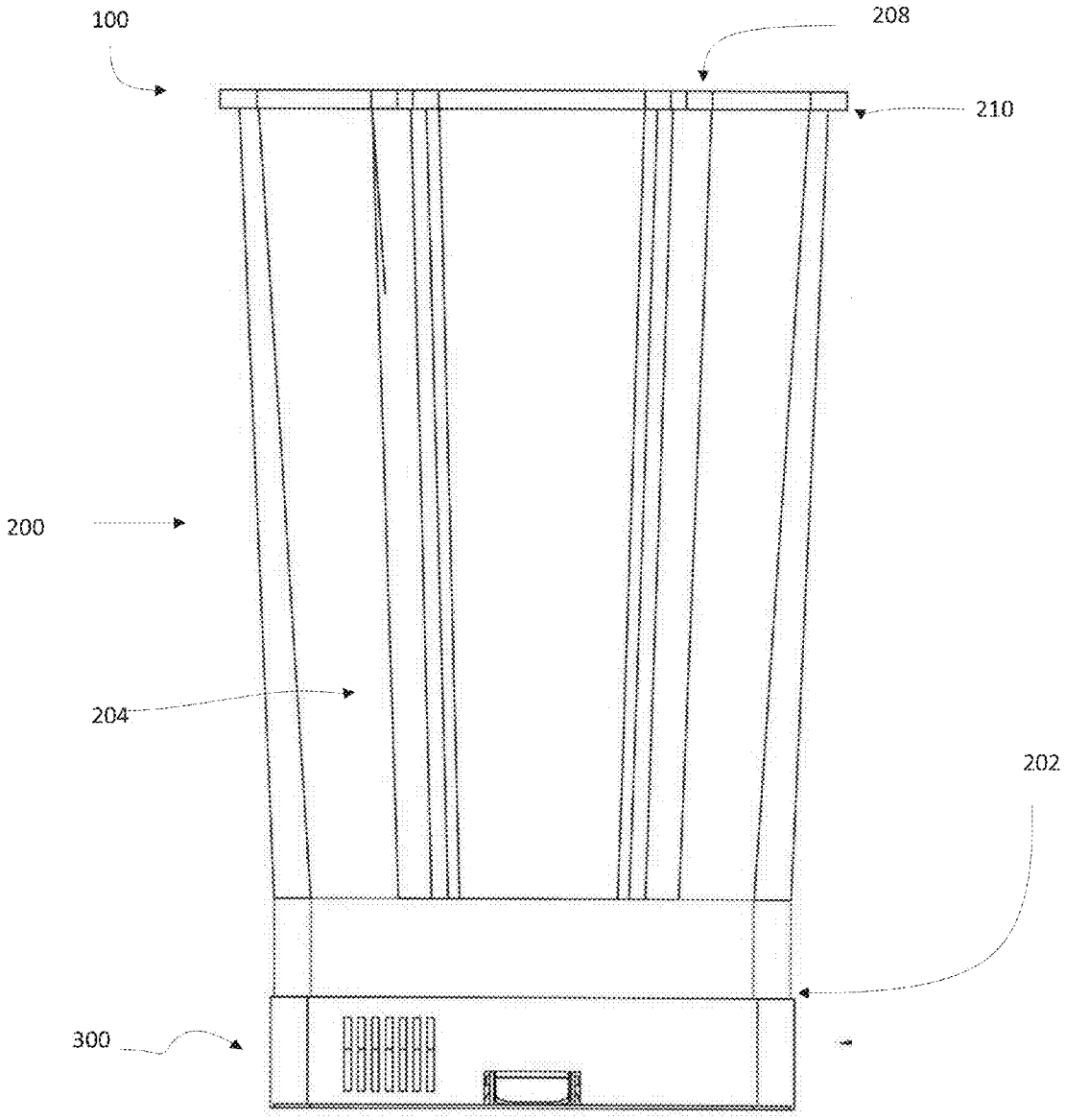
FIG. 2 is a front view of an example receptacle.
Figure 3:
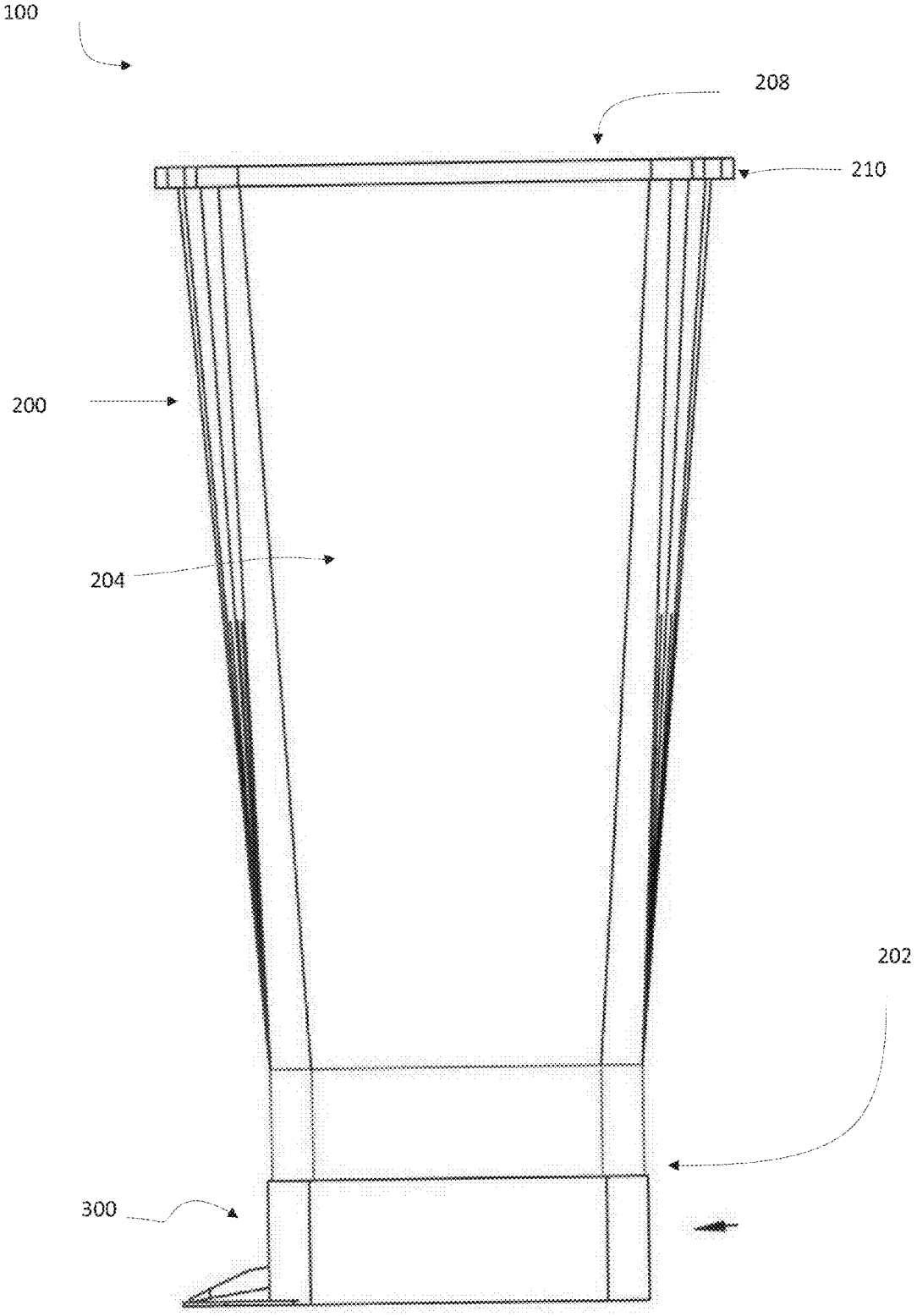
FIG. 3 is a side view of an example receptacle.
Figure 4:
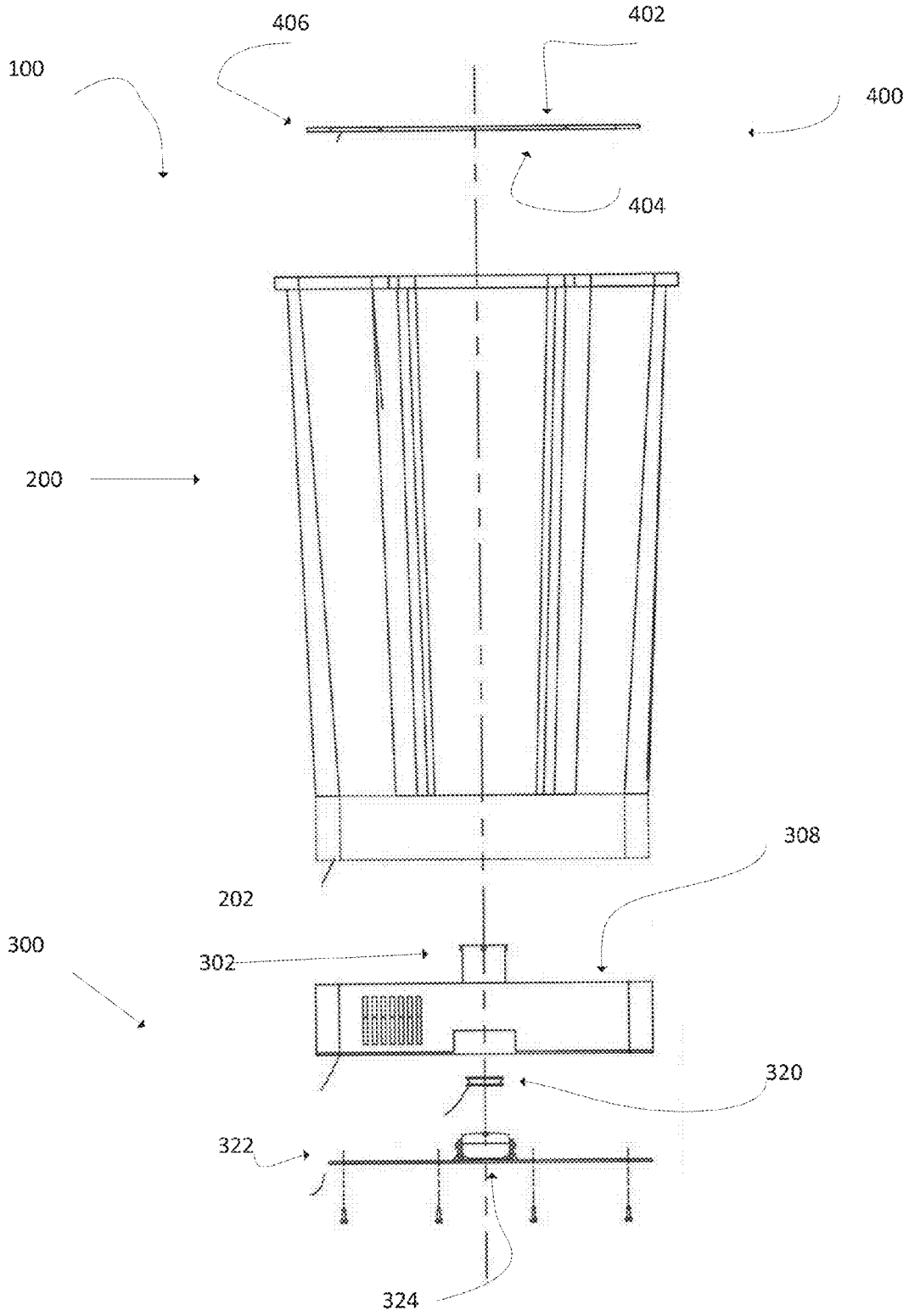
FIG. 4 is an exploded view of an example receptacle.

Certain terminology is used herein for convenience only and is not to be taken as a limitation on the present disclosure. In the drawings, the same reference numbers are employed for designating the same elements throughout the several figures. A number of examples are provided, nevertheless, it will be understood that various modifications can be made without departing from the spirit and scope of the disclosure herein. As used in the specification, and in the appended claims, the singular forms "a," "an," "the" include plural referents unless the context clearly dictates otherwise. The term "comprising" and variations thereof as used herein is used synonymously with the term "including" and variations thereof and are open, non-limiting terms. The directional terms "vertical and "horizontal" are used to describe components merely for the purposes of clarity and illustration and are not meant to be limiting. Also, the words "inner" and "outer" refer to directions toward and away from, respectively, the geometric center of the described feature or device. The term "coupling" or "coupled" refers to using adhesives, bolts, welds, clamps, screws, clips and any other fasteners as known in the art.

In the following discussion, various embodiments of the receptacle are shown in the drawings as generally rectangular and are described as having a peripheral sidewall, however it should be understood that the trash receptacle container could be square, rectangular oval circular or other suitable configuration.

Certain exemplary implementations of the disclosure will now be described with reference to the drawings. In general, such implementations relate to receptacles configurable for the removal of air or atmosphere.

FIGS. 1-4 illustrates an example of a disclosed receptacle 100. The receptacle 100 includes a container 200, a first standoff 216, and an air-permeable support 400. The receptacle 100 can be configured to allow for the removal of air from within the receptacle 100. Additionally, the receptacle 100 can be configured to prevent the passage of liquid and solids through the bottom of the receptacle 100 while still allowing the removal of air from within the receptacle 100.

An example container 200 can be a typical container used to hold a liner. A liner can be for example a trash bag liner, a flexible liner, a disposable liner or any other suitable liner. The container 200 comprises a bottom wall 202 and a side peripheral wall 204. The bottom wall 202 can include an interior bottom surface 212 and an exterior bottom surface 214. The bottom interior surface 212 and the bottom exterior surface 214 can be substantially horizontal and vertically opposed to each other. The peripheral sidewall 204 can extend upwardly from the bottom wall 202. The peripheral sidewall 204 can circumscribe a receptive cavity 206 and terminate in an open top end 208. The open top end 208 can have a rim 210. The receptive cavity 206 and/or the rim 208 can be configured to receive the disposable liner. The container 200 can embody a cylindrical, tubular, circular, elliptical, square, rectangular shape or any other suitable shape that can accept a liner.

Figure 5:
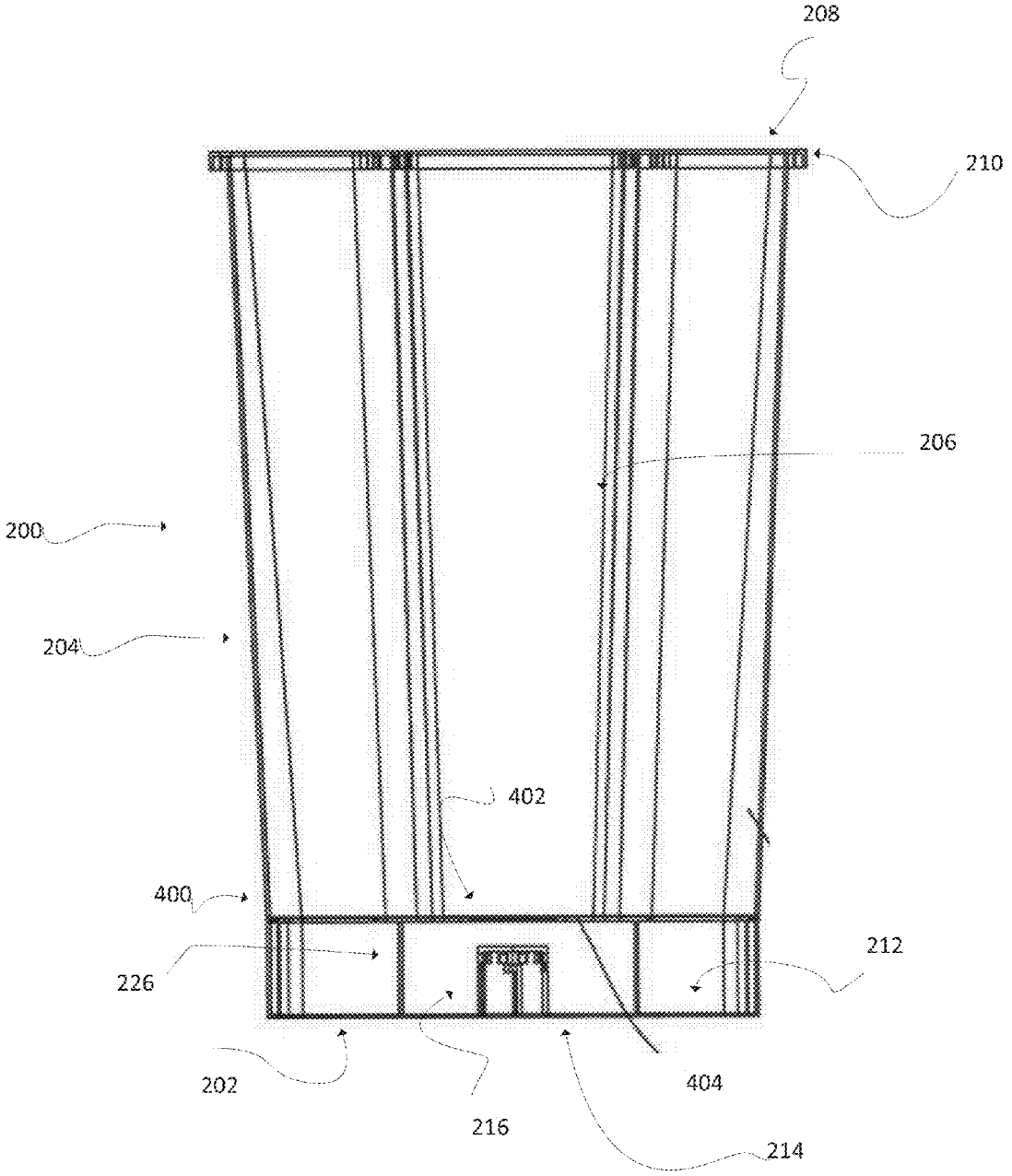
FIG. 5 is a vertical cross sectional view of an example receptacle.
Figure 6:
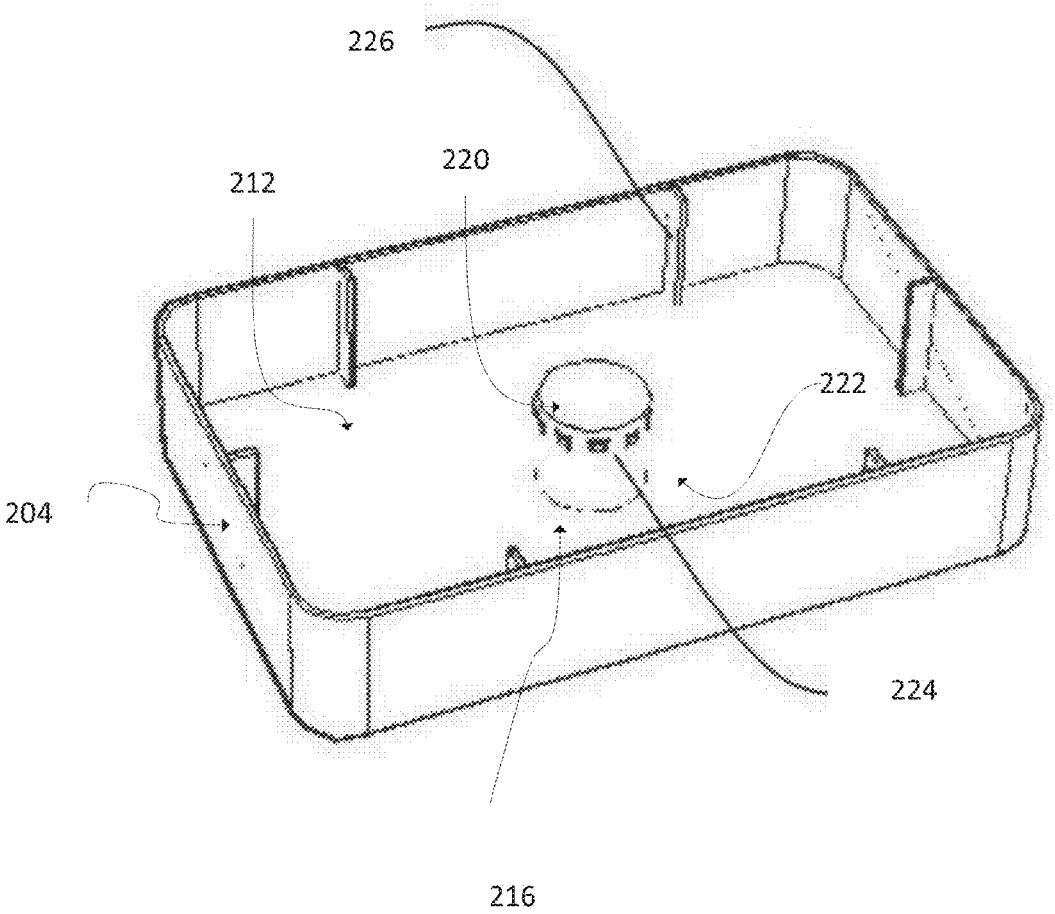
FIG. 6 is a horizontal cross sectional view of an example receptacle.
Figure 7:
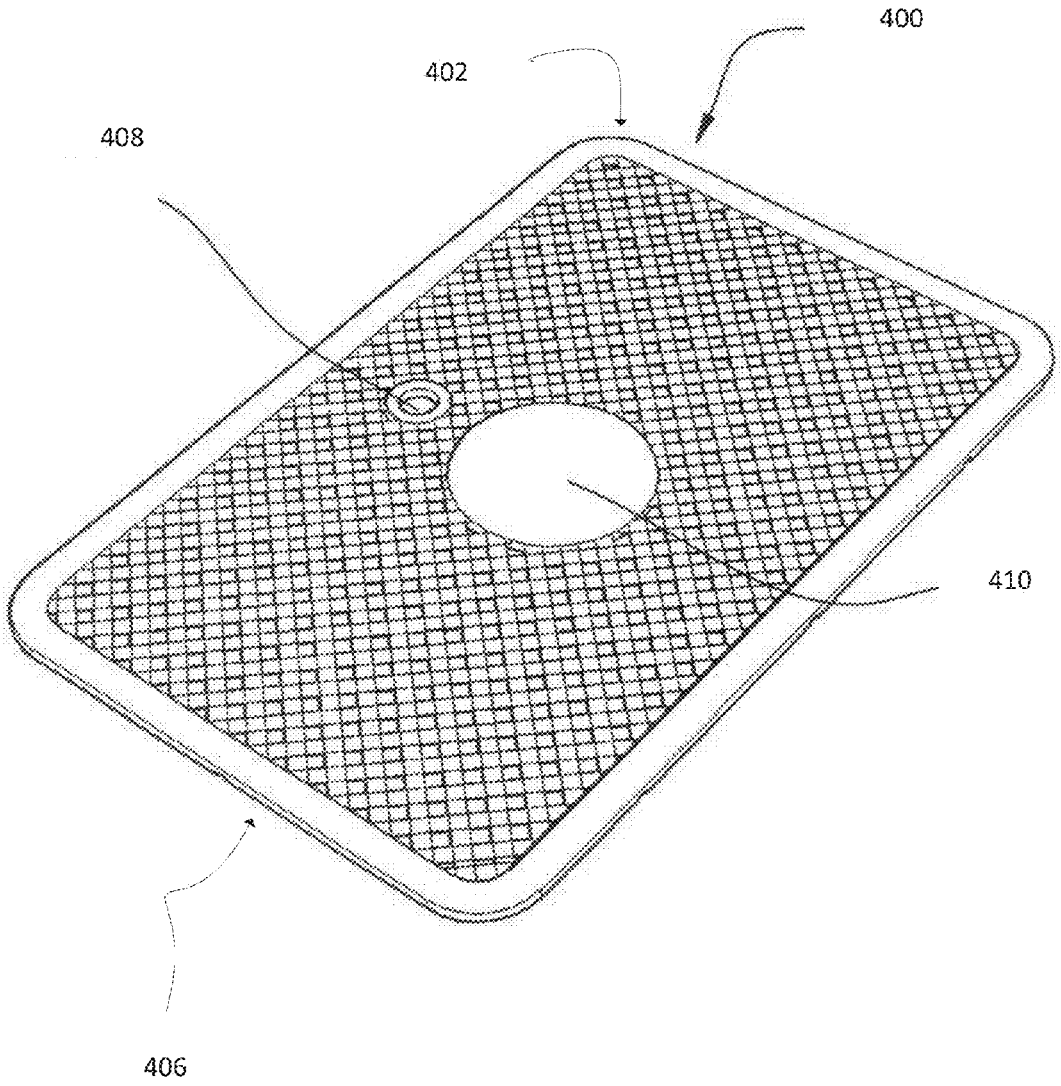
FIG. 7 is a perspective view of an example air-permeable support.

As illustrated in FIGS. 5-6, the receptacle 100 also includes an example first standoff 216. A first standoff 216 can be disposed on the bottom interior surface 212 of the bottom wall 202. The first standoff 216 can allow for the transfer of air from within the receptive cavity 206 while preventing the passage of liquids and solids. The first standoff 216 can transfer air from the receptive cavity 206 to a location below the container 200.

The first standoff 216 can include a top surface 220 positioned at a second distance from the bottom interior surface 212 and can also include a peripheral sidewall 222. The peripheral sidewall 222 of the first standoff 216 can extend upwardly from the bottom interior surface 212. The peripheral sidewall 222 of the first standoff 216 can circumscribe a first gas transfer chamber. Additionally, the peripheral sidewall of the first standoff can have at least one hole 224. The at least one hole 224 can be positioned at a first distance from the bottom interior surface 212. The at least one hole 224 can be configured in such a way as to provide fluid communication between the receptive cavity 206 and the first gas transfer chamber.

Additionally, the first standoff 216 can be configured in such a way so that upon a rupture of a disposable liner, liquid and solids from within the liner are retained within the receptive cavity 206. Additionally, the first standoff 216 can be configured so that liquids and solids do not enter through the first standoff 216 so long as the liquids and solids do not reach the at least one hole 224. One way this can be done is by first calculating a first distance to bottom interior surface ratio by estimating the likely volume of a typical a trash liner and then determining the first distance of the peripheral sidewall of the first standoff 216 in such a way so as that if the volume rests upon the bottom interior surface 212, the height of the volume resting on the bottom interior surface 212 would not exceed the first distance.

The first standoff 216 can further comprise an opening (not shown) at the top surface 220 of the first standoff 216. The opening at the top surface 220 of the first standoff 216 allows for another entry point for the air transferred from the receptive cavity 206. The opening at the top surface 220 of the first standoff 216 can be in fluid communication with the first gas transfer chamber.

As illustrated in FIGS. 4, 5, 7 and 8, the receptacle 100 also includes an example air-permeable support 400. The air-permeable support 400 can, for example, allow for the passage of air between the receptive cavity 206 and a location below the first standoff 216. The air-permeable support 400 can comprise a top surface 402, a bottom surface 404, and a peripheral surface 406. The top surface 402 and the bottom surface 404 can have a plurality of holes that allow for the passage of air from the top surface 402 to the bottom surface 404. For example, the tops surface 402 and the bottom surface 404 can include a rigid and/or flexible screen.

The air-permeable support 400 can be removably couplabled to the peripheral sidewall 204 of the container 200. Additionally the air-permeable support 400 can be positioned at a third distance from the bottom interior surface 212. The air-permeable support can also be positioned above the top surface 220 of the first standoff 216. Positioning the air-permeable support above the top surface 220 of the first standoff 216 can prevent the disposable liner from overly surrounding the first standoff 216 and preventing the venting of air. Having the disposable liner retained away from the first standoff 216 can also help reduce the risk of the disposable liner rupturing from excessive strain to the liner cause by the removal of air from the receptive cavity 206.

As illustrated in FIGS. 1-5 and 7-8, the peripheral sidewall 204 of the container 200 can be tapered which can provide one way that the air-permeable support 400 can be coupled to the peripheral sidewall 204 of the container 200. The air-permeable support 400 can be coupled here using the friction between the tapered peripheral sidewall 204 of the container 200 and the peripheral sidewall 406 of the air-permeable support 400.

Additionally, when the first standoff 216 includes an opening as described above, the air-permeable support 400 can further include a non-porous portion 410 of the air-permeable support 400 directly opposing the opening in the top surface 220 of the first standoff 216. The non-porous portion 410 can provide additional protection that liquids and solids will likely not enter the at least one hole 224 of the first standoff 216. For example, the non-porous portion can be located directly above the first standoff 216 and the shape and size of the portion can be determined based on the shape and size of the top surface 220 of the first standoff 216.

Figure 8:
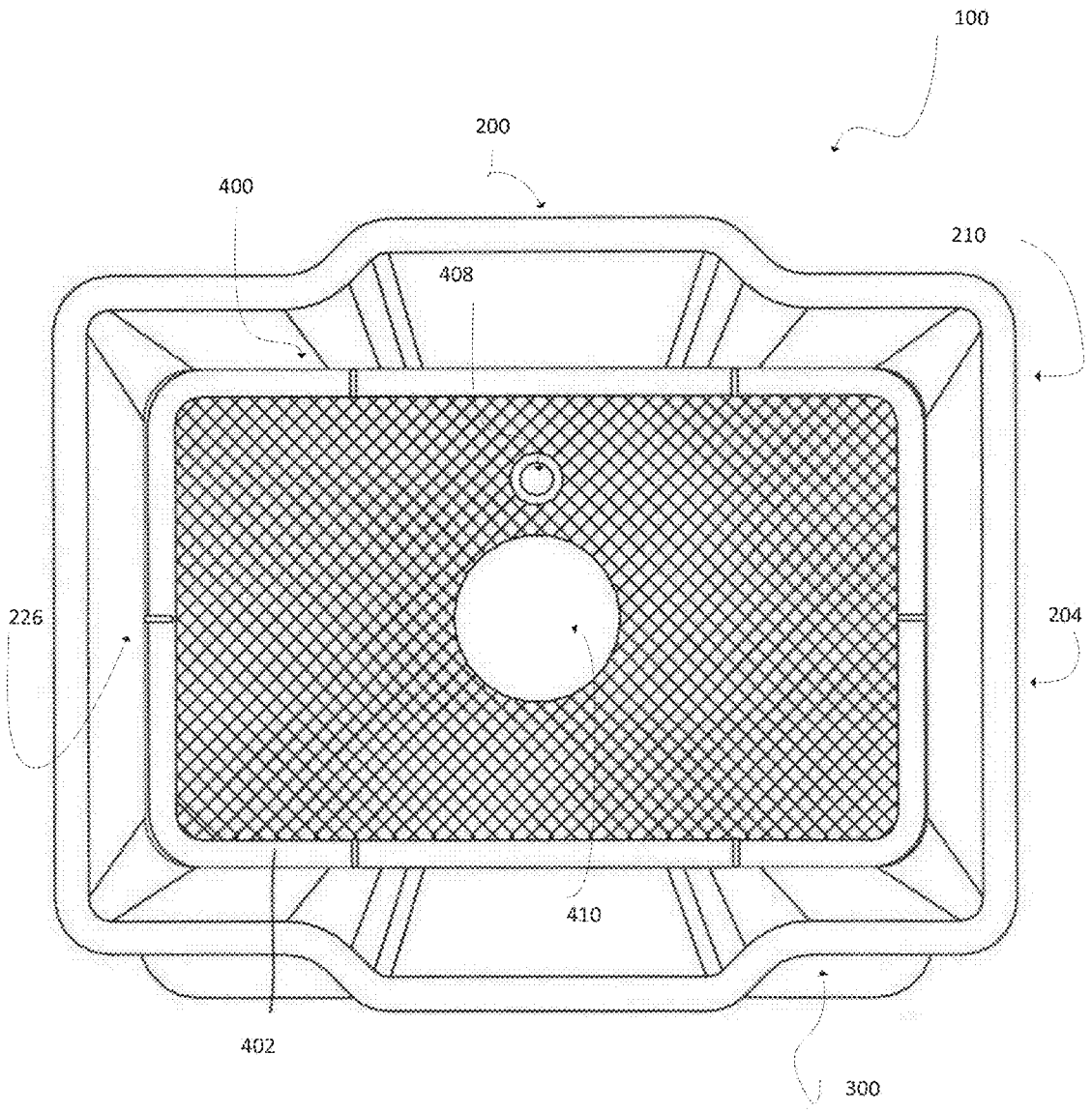
FIG. 8 is a top view of an example receptacle with an air-permeable support.

As illustrated in FIGS. 5, 6 and 8, the peripheral sidewall 204 of the container 200 can comprise an example rim 226. A rim 226 can allow for an air-permeable support 400 to be coupled to the peripheral sidewall 204 of the container 200. For example, the rim 226 of the peripheral sidewall 204 of the container 200 can horizontally circumscribe the peripheral sidewall 204 of the container 200. The rim 226 of the sidewall of the container 200 can extend away from the peripheral sidewall (as seen in FIG. 6) or extend into the peripheral sidewall 204 of the container 200 (not shown).

As illustrated in FIGS. 1-4, and 9-12, the receptacle 100 can also include an example base 300. The base 300 can be weighted such that the center of gravity and/or mass of the receptacle 100 is lowered and/or centered to prevent unintentional movement/tipping of the receptacle 100. The base 300 can be weighted such that the overall center of mass/gravity of the receptacle 100 moves towards a central axis of the receptacle 100. In another example, the base can include anchoring elements to fix/mechanically couple the base 300 to a ground/support structure. The base can have a top surface 308, a bottom surface 311 and a peripheral sidewall 309.

The top surface 308 of the base 300 can be removable coupleable to the bottom exterior surface 214 of the container 200. Removably coupling the base 300 from the container 200 allows at least for more efficient cleaning of the receptacle. Additionally, this allows for the protection of the contents of the base 300 from any accidental contact with potentially damaging chemicals. In another example, the bottom exterior surface 215 of the container 200 can be removably coupled by using a twist and lock system.

Figure 9A:
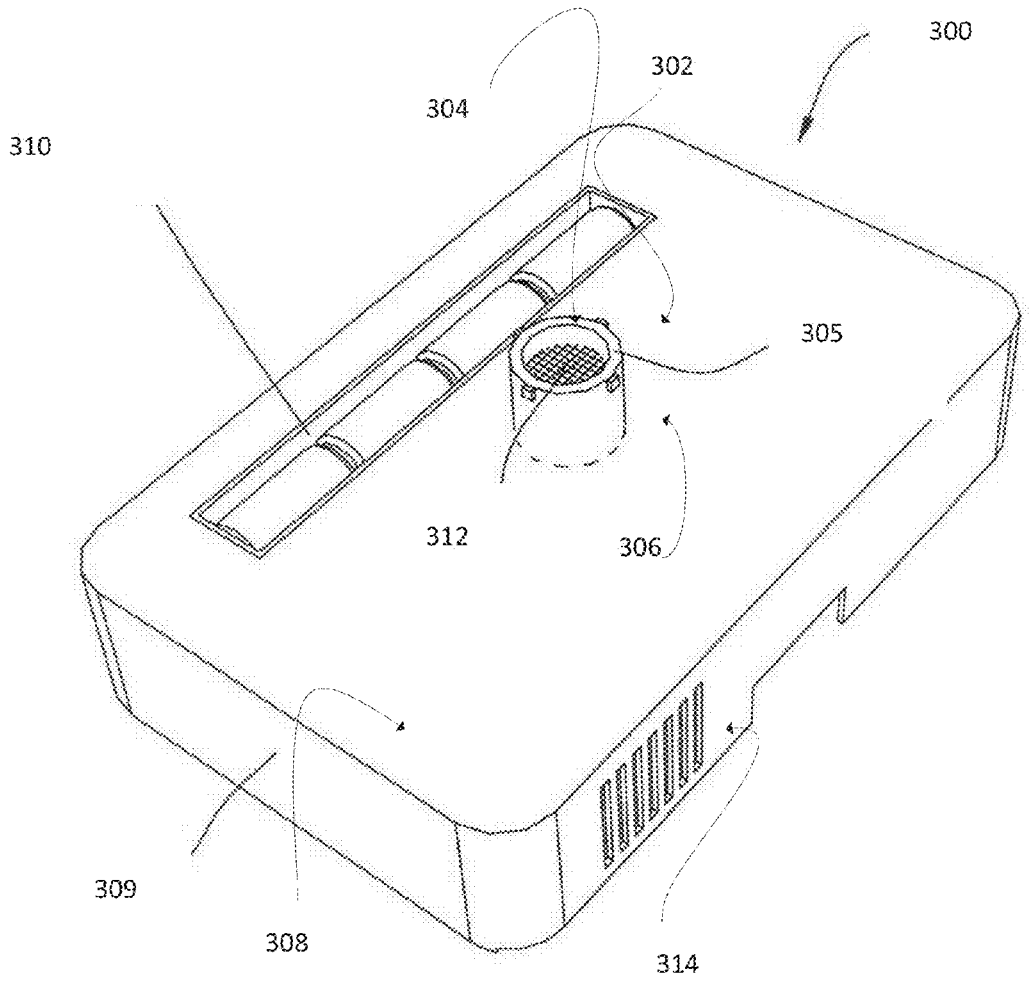
FIG. 9A is a perspective view of an example base.
Figure 9B:
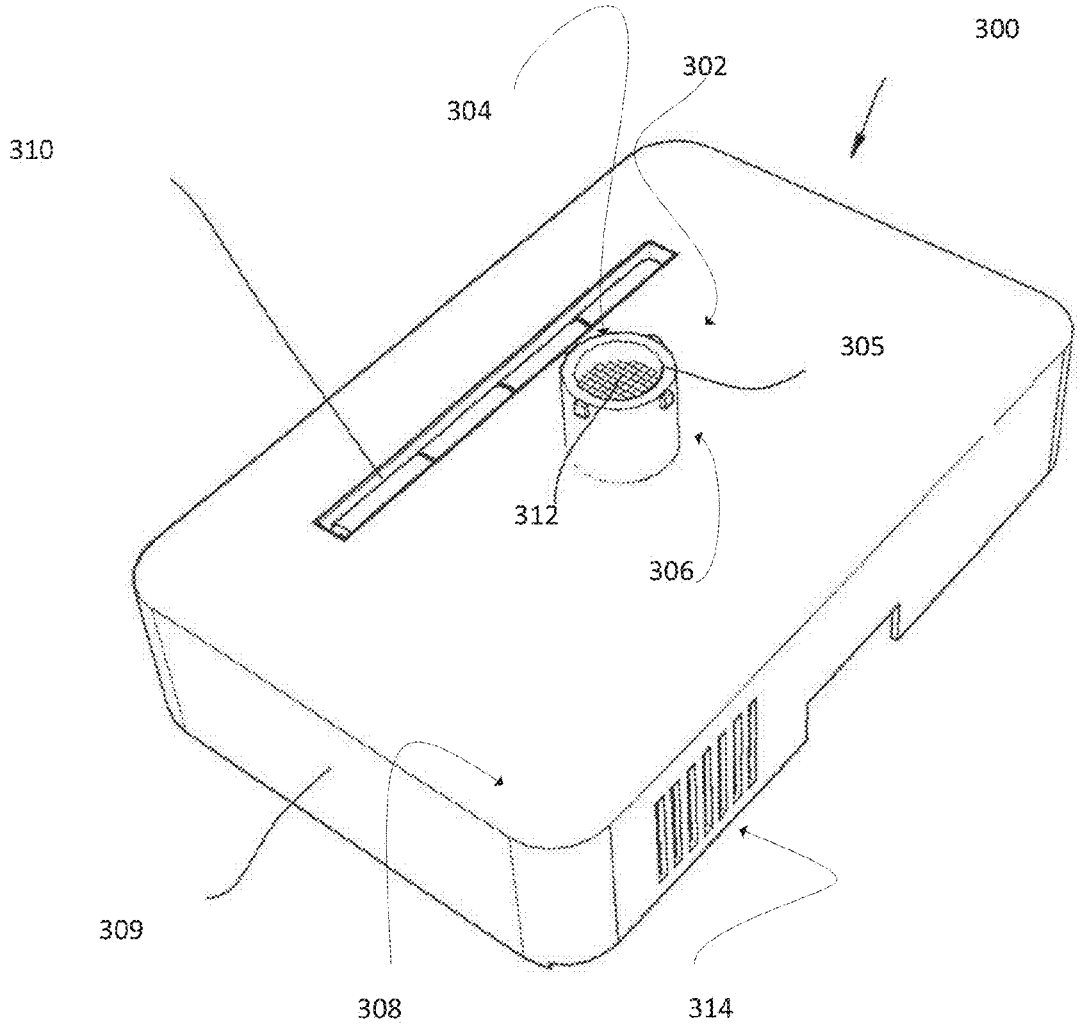
FIG. 9B is a perspective view of an example base.
Figure 10:
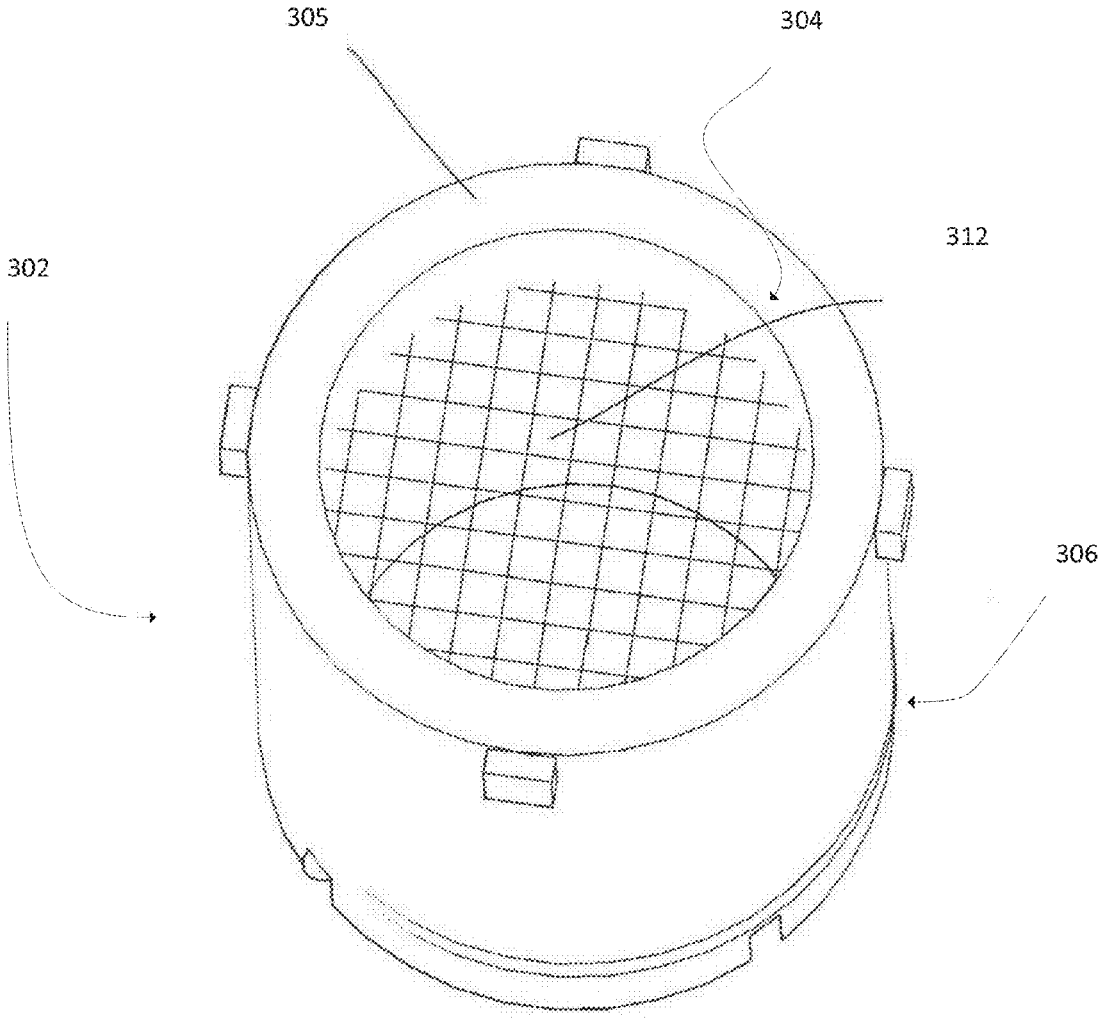
FIG. 10 is a perspective detail view of an example second standoff positioned on a base.

As illustrated in FIGS. 9-10, the base 300 can additionally include an example second standoff 302. The second standoff 302 can provide a fluid connection between the first standoff 216 and an apparatus 320 for removing air or atmosphere from within the receptive cavity 206. The second standoff 302 can be disposed on the top surface 308 of the base 300. The second standoff 302 can include a top opening 304 and a peripheral sidewall 306. The peripheral sidewall 306 of the second standoff 302 can extend downwardly from the top opening 304. The peripheral sidewall 306 of the second standoff 302 can circumscribe a second gas transfer chamber. Furthermore, the peripheral sidewall 306 of the second standoff 302 can terminate at the top surface 308 of the base 300. When the base 300 is coupled to the container 200 the second gas transfer chamber can be fluidly connected to the first gas transfer chamber and the receptive cavity 206.

The second standoff 302 can additionally include an air-permeable barrier 312. The air permeable member 312 can include a top surface, a bottom surface, and a peripheral surface. The air-permeable barrier 312 can be coupled to the peripheral sidewall 306 of the second standoff 302.

Figure 11:
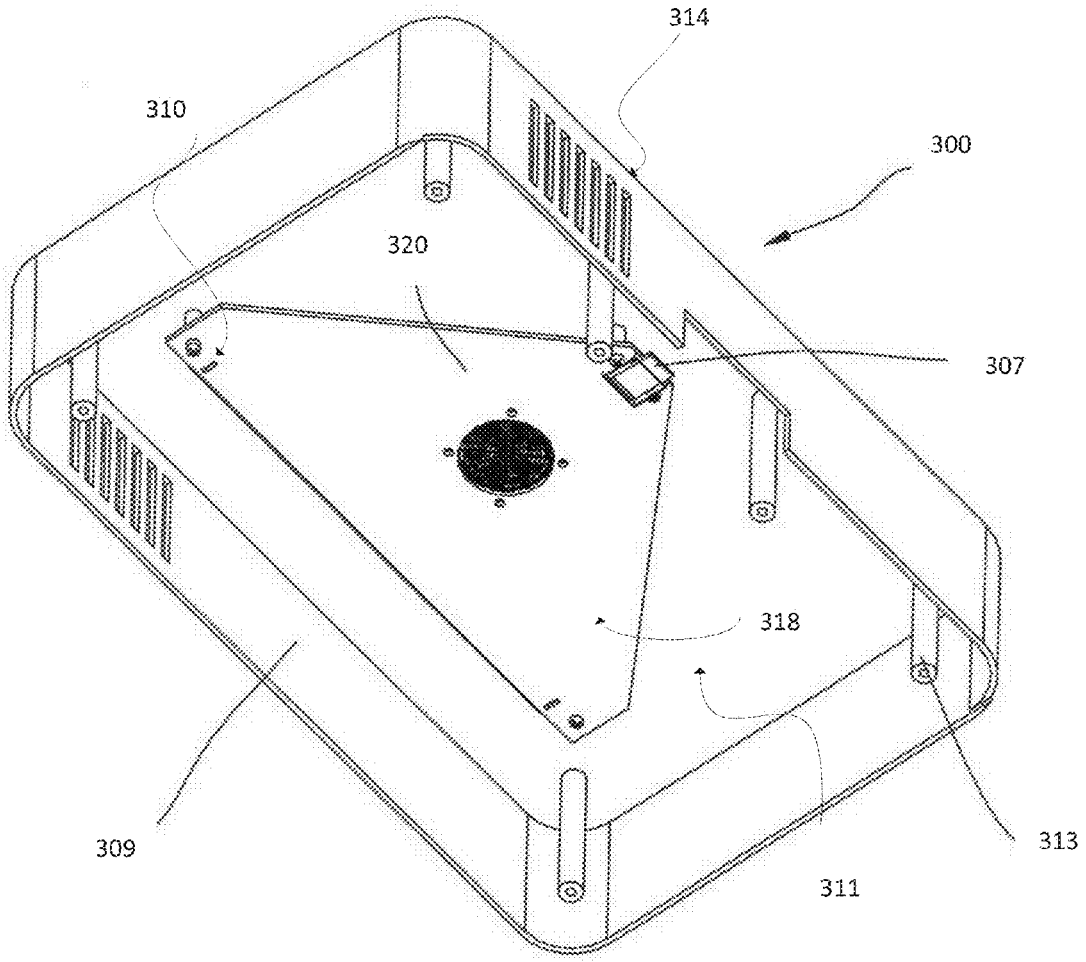
FIG. 11 is a perspective view of an example apparatus for transferring air or atmosphere coupled to a base.
Figure 12:
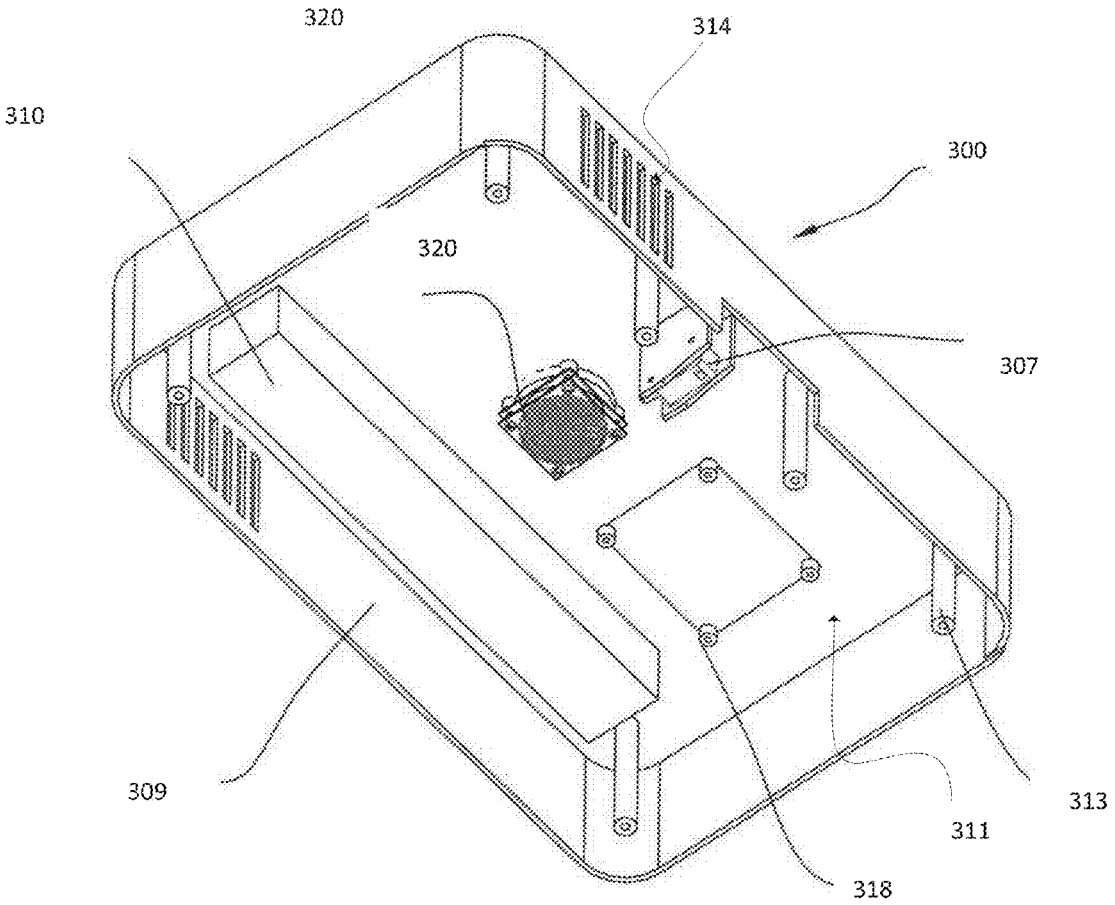
FIG. 12 is a perspective view of an example apparatus for transferring air or atmosphere coupled to a base.

As illustrated in FIGS. 11 and 12, the receptacle 100 can additionally include an apparatus 320 that can be coupled to the bottom surface of the base 311. The apparatus 320 can be configured to transfer air or atmosphere from the receptive cavity 206 of the container 200. The apparatus 320 can transfer the air or atmosphere through the first and second gas transfer chambers and to an exhaust vent 314. The exhaust vent 314 can be positioned in the peripheral sidewall 309 of the base 300.

The apparatus 320 can embody any suitable system for the removal of air including a blower, a hand pump, and a fan. The apparatus 320 can be operatively coupled to a power source 310, and a switch 307. The power source 310 can be for example batteries of different sizes as shown in FIGS. 9A and 9B. The power source 310 can also be any other suitable power source such as an AC or DC current source. The switch 307 can be any suitable switch that can be configured to engage the apparatus 320, upon activation by a user. For example, a switch 306 can embody a mechanical switch or an electrical switch. The apparatus 320 can additionally be operatively coupled to a timing circuit 318. In one example, the timing circuit 318 can be configured to rotate a fan for a predetermined amount of time.

Figure 13:
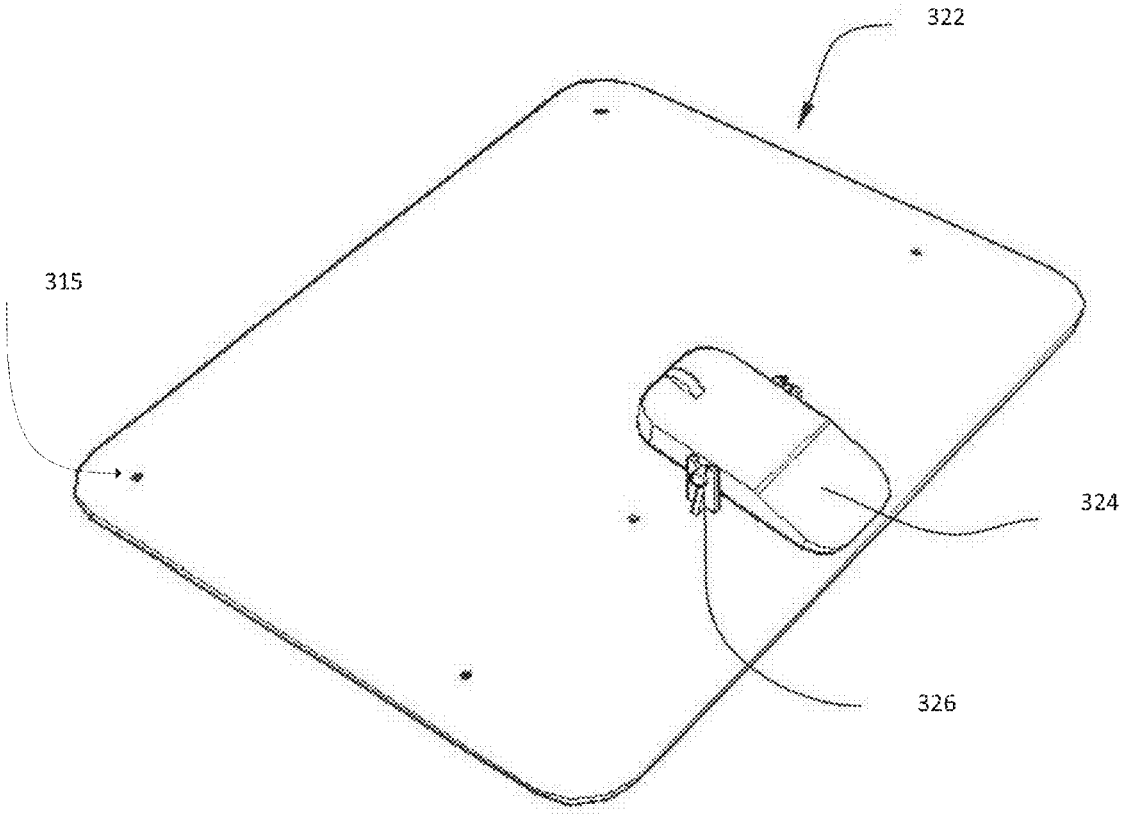
FIG. 13 is a perspective view of an example actuator coupled to an example actuator support.

As illustrated in FIG. 13, the receptacle 100 can additionally include an actuator 324. The actuator 324 can be operatively coupled to the switch 307 and coupled to an actuator base 322. The actuator base 322 can be coupled to the base 300. One way the actuator base 322 can be coupled to the base 300 is through the use of a bolts that thread through connector ports 315 and fasted to receptive connector ports 313 positioned at the bottom of surface 311 of the base 300. The actuator 324 can embody any suitable human machine interface for triggering a mechanical or electric system. The actuator 324 can be for example, a button, a lever, and/or a foot petal.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A receptacle comprising:

a container having a bottom wall and a peripheral sidewall extending upwardly therefrom circumscribing a receptive cavity and terminating in an open top end having a rim, wherein the bottom wall includes a bottom interior surface and a bottom exterior surface, and wherein the rim and the receptive cavity are configured to receive a disposable liner;

a first standoff disposed on the bottom interior surface of the bottom wall comprising:

a peripheral sidewall extending upwardly from the bottom interior surface that circumscribes a first gas transfer chamber, wherein the peripheral sidewall of the first standoff is perforated with at least one hole positioned a first distance from the bottom interior surface and the at least one hole is configured to provide fluid communication between the receptive cavity and the first gas transfer chamber, and a top surface positioned a second distance from the bottom interior surface; and an air-permeable support comprising a top surface, a bottom surface, and a peripheral surface removably coupleable to the peripheral sidewall of the container at a third distance from the bottom interior surface above the top surface of the first standoff.

2. The receptacle of claim 1, further comprising:

a base having a top surface, a bottom surface, and a peripheral sidewall, wherein the top surface of the base is removably coupleable to the bottom exterior surface of the container.

3. The receptacle of claim 2, wherein the base of the receptacle comprises:

a second standoff disposed on the top surface of the base comprising a top opening and a peripheral sidewall extending downwardly from the top opening that circumscribes a second gas transfer chamber and terminates at the top surface of the base, wherein the second standoff is operably coupleable to the first standoff, and wherein the second gas transfer chamber is fluidly connected to the first gas transfer chamber and the receptive cavity when the base is coupled to the container.

4. The receptacle of claim 3, wherein the second standoff further comprises an air-permeable barrier, wherein the air-permeable barrier comprises a top surface, a bottom surface, and a peripheral surface, wherein the air-permeable barrier is coupled to the peripheral sidewall of the second standoff.

5. The receptacle of claim 4 further comprising:

an apparatus coupled to the bottom surface of the base configured to transfer air or atmosphere from the receptive cavity of the container, through the first and second gas transfer chambers to an exhaust vent positioned in the peripheral sidewall of the base.

6. The receptacle of claim 5, wherein the apparatus comprises a fan subsystem operatively coupled to a power source and switch, wherein the switch is configured to engage the apparatus upon activation by a user.

7. The receptacle of claim 6, wherein the fan subsystem comprises fan operatively coupled to a timing circuit, wherein the timing circuit is configured to rotate the fan for a predetermined amount of time.

8. The receptacle of claim 7, wherein the base further comprises an actuator operatively coupled to the switch.

9. The receptacle of claim 8, wherein the actuator is a foot pedal and the foot pedal is coupled to the base.

10. The receptacle of claim 1, wherein the peripheral sidewall of the container is tapered and the air-permeable support is coupled to the peripheral sidewall using the friction between the peripheral sidewall of the container and the peripheral sidewall of the air-permeable support.

11. The receptacle of claim 1, wherein the peripheral sidewall of the container comprises a rim that horizontally circumscribes the peripheral sidewall of the container and wherein the air-permeable support is coupled to the rim of the peripheral sidewall of the container.

12. The receptacle of claim 11, wherein the rim of the peripheral sidewall of the container extends away from the peripheral sidewall of the container.

13. The receptacle of claim 11, wherein the rim of the peripheral sidewall of the container extends into the peripheral sidewall of the container.

14. The receptacle of claim 1, wherein the bottom interior surface of the container and the bottom exterior surface of the container are substantially horizontal surfaces that are vertically opposed to each other.

15. The receptacle of claim 1, where the first standoff is configured in such a way so that upon a rupture of the disposable liner, liquids and solids from within the disposable liner are retained within the receptive cavity and do not enter through the first standoff so long as the liquids and solids do not reach the at least one hole positioned the first distance from the bottom interior surface.

16. The receptacle of claim 1, where the first standoff is cylindrical.

17. The receptacle of claim 1, wherein the air-permeable support is configured to retain the disposable liner above the first standoff.

18. The receptacle of claim 17, wherein the first standoff further comprises a opening in the top surface of the first standoff that is in fluid communication with the first gas transfer chamber, and wherein the air-permeable support comprises a non-porous portion that directly opposes the opening in the top surface of the first standoff.

19. A receptacle comprising:

a container having a bottom wall and a peripheral sidewall extending upwardly therefrom circumscribing a receptive cavity and terminating in an open top end having a rim, wherein the bottom wall includes a bottom interior surface and a bottom exterior surface, and wherein the rim and the receptive cavity are configured to receive a disposable liner;

a first standoff disposed on the bottom wall comprising:

a peripheral sidewall extending upwardly from the bottom interior surface that circumscribes a first gas transfer chamber, wherein the peripheral sidewall of the first standoff is perforated with at least one hole positioned a first distance from the bottom interior surface that is configured to provide fluid communication between the receptive cavity and the first gas transfer chamber, and a top surface positioned a second distance from the bottom interior surface; and an air-permeable support comprising a top surface, a bottom surface, and a peripheral surface removably coupleable to the peripheral sidewall of the container at a third distance from the bottom interior surface above the top surface of the first standoff;

a base having a top surface, a bottom surface, and a peripheral sidewall, wherein the top surface of the base is removably coupleable to the bottom exterior surface of the container, wherein the base of the receptacle comprises a second standoff disposed on the top surface of the base comprising a top opening and a peripheral sidewall extending downwardly from the top opening that circumscribes a second gas transfer chamber and terminates at the top surface of the base, wherein the second standoff is operably coupleable to the first standoff, and wherein the second gas transfer chamber is fluidly connected to the first gas transfer chamber and the receptive cavity when the base is coupled to the container; and an apparatus coupled to the bottom surface of the base configured to transfer air or atmosphere from the receptive cavity of the container, through the first and second gas transfer chambers to an exhaust vent positioned in the peripheral sidewall of the base.

* * * * *